US005584593A

United States Patent [19]

Lafortune

[11] Patent Number: 5,584,593

[45] Date of Patent: Dec. 17, 1996

[54] DISPOSABLE, REUSABLE TOOTHBRUSH WITH TOOTHPASTE IN HANDLE

[76] Inventor: Ricardo Lafortune, 820 E. Curtis St., Linden, N.J. 07036

[21] Appl. No.: 494,390

[22] Filed: Jun. 26, 1995

[51] Int. Cl.[6] ..... A46B 11/02

[52] U.S. Cl. ..... 401/184; 401/268; 401/269; 401/287

[58] Field of Search ..... 401/184, 268, 401/269, 287

[56] References Cited

U.S. PATENT DOCUMENTS 1,142,566 6/1915 Jackson ..... 401/184

2,550,190 4/1951 Greenberg ..... 401/268 X 2,813,290 11/1957 Aschenbach ..... 401/184

*Primary Examiner*—Steven A. Bratlie

*Attorney, Agent, or Firm*—Richard L. Huff

[57] ABSTRACT

A toothbrush containing a hollow handle, a neck and a head. The hollow handle contains toothpaste and a compressible plastic pad. When pressure is applied to the plastic pad, toothpaste is forced from the hollow handle through a duct in the neck and out of openings between bristle tufts on the head. A self-adhering plastic cover covers the openings in the head to prevent crusting or the toothpaste. The plastic cover may be reapplied following use to allow for a plurality of uses before the toothbrush is discarded.

3 Claims, 2 Drawing Sheets

DISPOSABLE, REUSABLE TOOTHBRUSH WITH TOOTHPASTE IN HANDLE

BACKGROUND OF THE INVENTION

1. Field of the Invention

The present invention relates to reuseable, disposable toothbrushes which contain toothpaste in the handles.

2. Description of the Related Art

Toothbrushes which contain toothpaste in their handles are known in the art. U.S. Pat. No. 4,221,492 is an example of such toothbrushes. Such toothbrushes have the advantage of eliminating the need for both a toothbrush and a toothpaste tube. In the past, such toothbrushes have been intended for long-time use. As a result, the issue of refilling the handles with toothpaste has had to be addressed. Complex and expensive solutions to this problem have appeared. Also, in the prior toothbrushes, valves have been used which prevent the expuslion and waste of toothpaste and the contact of the toothpaste with air which would result in caking. Such valves add significantly to the cost of the toothbrushes. Thus, there is a need for toothbrushes which contain toothpaste in their handles, yet are simple in design and inexpensive to manufacture.

SUMMARY OF THE INVENTION

One object of this invention is to satisfy the needs noted above and provide an inexpensive combination of toothbrush and toothpaste which is efffective to provide toothpaste from the handle to the bristles of the toothbrush.

Another object of this invention is to provide a combination of toothbrush and toothpaste in which the toothbrush may be disposed of after from one to three brushings.

Another object of this invention is to provide an inexpensive method for preventing the expulsion of toothpaste from the handle and the concurrent wasting and caking of toothpaste.

Further advantages of the present invention will become apparent from a reading of the following description.

In order to accomplish the above objects, a toothbrush is provided having a front and back surface and a handle, neck and head. The handle contains a hollow area which is large enough to contain sufficient toothpaste for one to three brushings. The hollow area containing the toothpaste is covered with a compressible plastic pad which allows for the forcing of the toothpaste from the hollow area. The neck of the toothbrush contains a duct which leads from the hollow area of the handle to openings which are in the head of the toothbrush. There are four to eight openings evenly dispersed throughout the bristle tufts in the head of the toothbrush. The toothpaste is evenly forced through these openings to the bristle tufts to be ready for use. When not in use, a self-adhering plastic cover is arranged to cover the openings to prevent escape of the toothpaste and contact of the toothpaste with air, which would lead to caking. After use, the toothbrush may be disposed of or the plastic cover may be replaced, and the toothbrush may be reused.

DESCRIPTION OF THE PREFERRED EMBODIMENTS

Figure 1:
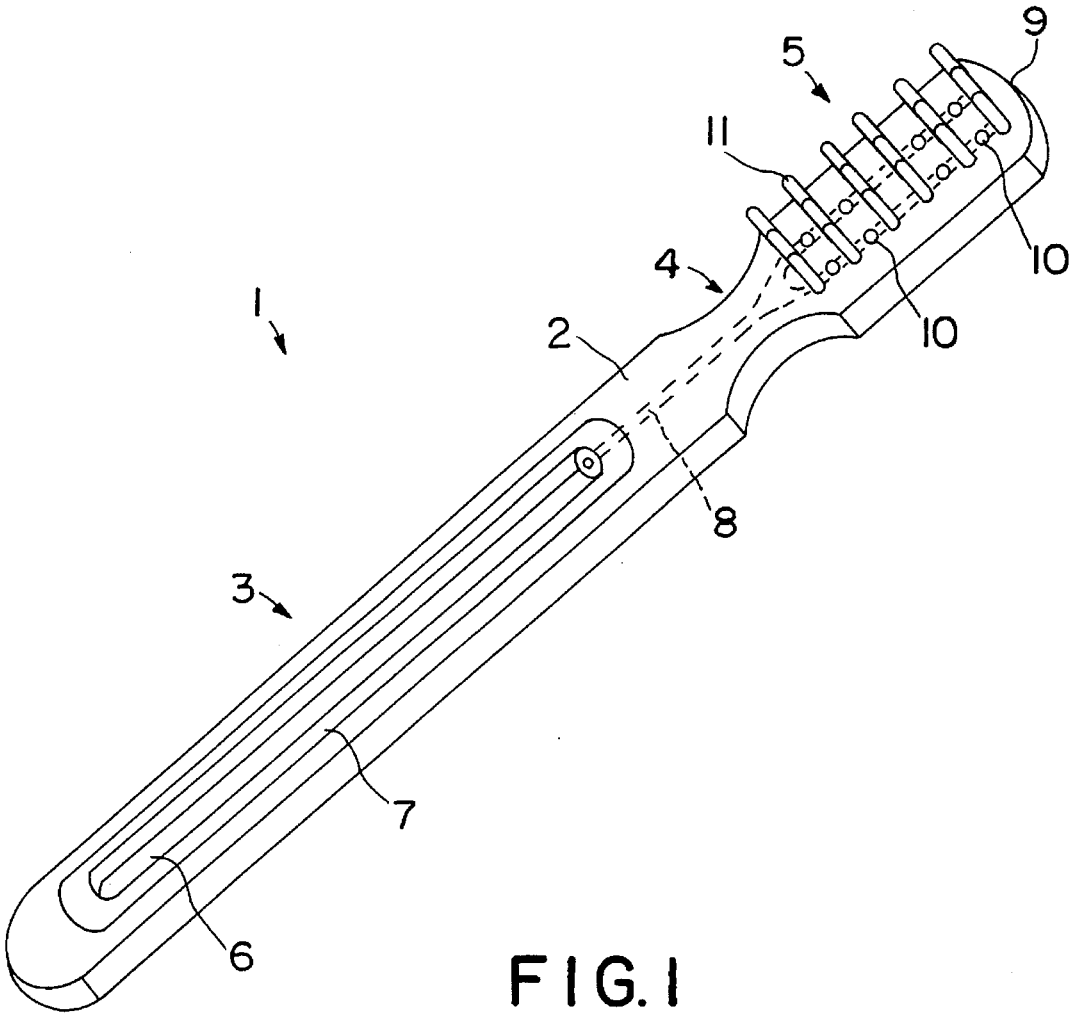
FIG. 1 is a perspective view of a toothbrush of this invention.

With reference to the figures, wherein like reference characters designate like or corresponding parts throughout the several figures, there is now described the toothbrush of the present invention.

FIG. 1 shows a toothbrush 1 having a front surface 2 and a back surface (not shown), a handle 3, a neck 4, and a head 5. The handle 3 has a hollow area 6 containing toothpaste (not shown). The hollow area 6, after being filled with toothpaste, is covered with a compressible plastic pad 7. The compressible pad 7 is adhered to the handle 3 by means of an adherent resin or other adhesive capable of fixedly attaching the edges of the compressible pad 7 to the handle 3. Such adhesives are known in the art.

A duct 8 proceeds from the hollow area 6 through the neck 4 into the head 5. In the head 5, the duct 8 may divide into two or three ducts 8 or may remain as a single duct 8 proceeding toward the tip 9 of the head 5, but stopping short of the tip 9. In the head 5, the duct 8 has from four to eight openings 10 which open onto the front surface 2 of the head 5 evenly dispersed between the bristle tufts 11. The toothbrush 1 may be made of conventional theroplastic resin, and may be manufactured by molding methods which are known in the art. The bristle tufts 11 may be made of nylon or other materials known for this purpose, and inserted into the toothbrush head 5 in a manner known in the art.

Figure 2:
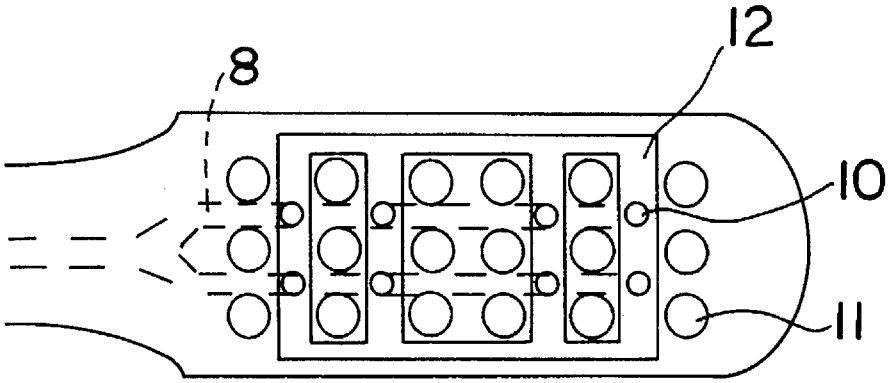
FIG. 2 is a plan view of the head of a toothbrush of this invention, showing the self-adhering cover in place.

FIG. 2 is an enlarged view of the head 5, showing the openings 10 covered by an adherent plastic cover 12.

Figure 3:
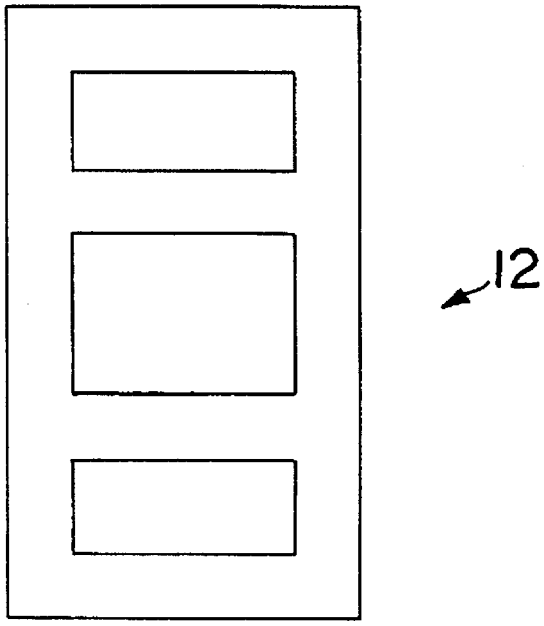
FIG. 3 is a plan view of the self-adhering cover.

FIG. 3. is a plan view of the plastic cover 12.

The plastic cover 12 may be made of adhering plastic material, such as Saran TM. The plastic cover 12 may be manufactured by punching strips of the plastic material into the desired shapes. The plastic cover 12 may easily be inserted between the bristle tufts 11 to cover the openings 10.

For use, the plastic covers may be removed from the front surface 2 of the head 5 to expose the openings 10. Pressure is then applied to the compressible pad 7 to force the toothpaste from the hollow area 6 in the handle 3 through the duct 8 through the openings 10 to surround the bristle tufts 11. Following a single use during which the teeth are brushed, the toothbrush may be discarded or the adherent plastic cover 12 may be reapplied to cover the openings 10. The toothbrushes 1 of the present invention are designed so as to be useful for from one to three brushings.

The invention in its broader aspects is not limited to the specific details shown and described, and departures may be made from such details without departing from the principles of the invention and without sacrificing its chief advantages.

I claim:

1. In a toothbrush containing a handle containing a front surface and a back surface, a head containing a front and a back surface with bristles on the front surface, and a neck connecting the handle and the head, the improvement comprising:

the handle containing a hollow area covered by a compressible plastic pad adhered to the front surface, the hollow area of the handle containing toothpaste, the neck containing a centrally located duct connecting the hollow area of the handle with the head, the head containing a plurality of bristle tufts on the front surface, the head containing four to eight openings on the front surface between bristle tuffs, the openings are covered with a self-adhering plastic cover, which plastic cover is reusable, and which plastic cover is rectangular in shape having a plurality of open areas which fit over the bristle tufts and having a plurality of crosspieces connecting longer ends of the rectangle, which crosspieces fit between the bristle tufts.

2. A method of using the toothbrush of claim 1, which comprises a) removing the self-adhering plastic cover which covers the openings, b) applying pressure to the compressible plastic pad on the front surface of the handle to force toothpaste from the hollow area of the handle to the front surface of the head, c) brushing one's teeth, and d) disposing of the toothbrush.

3. The method of claim 2, wherein, following step c), the self-adhering cover is replaced and the toothbrush is used up to three times before it is discarded.

* * * * *